US011454101B2

(12) United States Patent
Winkler et al.

(10) Patent No.: US 11,454,101 B2
(45) Date of Patent: Sep. 27, 2022

(54) DISSOLVABLE SETTING TOOL OR HYDRAULIC FRACTURING OPERATIONS

(71) Applicant: Halliburton Energy Services, Inc., Houston, TX (US)

(72) Inventors: Albert Winkler, Singapore (SG); Andrew Penno, Singapore (SG); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 16/765,976

(22) PCT Filed: May 8, 2020

(86) PCT No.: PCT/US2020/032255
§ 371 (c)(1),
(2) Date: May 21, 2020

(87) PCT Pub. No.: WO2020/236443
PCT Pub. Date: Nov. 26, 2020

(65) Prior Publication Data

US 2022/0003096 A1 Jan. 6, 2022

Related U.S. Application Data

(60) Provisional application No. 62/852,129, filed on May 23, 2019, provisional application No. 62/852,108, (Continued)

(51) Int. Cl.
*E21B 43/26* (2006.01)
*E21B 33/12* (2006.01)
(Continued)

(52) U.S. Cl.
CPC ..... *E21B 43/261* (2013.01); *E21B 23/06* (2013.01); *E21B 33/12* (2013.01);
(Continued)

(58) Field of Classification Search
CPC ..... E21B 33/134; E21B 43/26; E21B 33/12; E21B 33/1208; E21B 33/128
See application file for complete search history.

(56) References Cited

U.S. PATENT DOCUMENTS 3,078,797 A 2/1963 Blair
4,244,424 A 1/1981 Talbot
(Continued)

FOREIGN PATENT DOCUMENTS

CN 107013181 A 8/2017
EP 1264075 B1 6/2018
(Continued)

OTHER PUBLICATIONS

Korean Intellectual Property Office, PCT/US2020/026222, International Search Report and Written Opinion, dated Jul. 27, 2020, 13 pages, Korea.

(Continued)

*Primary Examiner* — Zakiya W Bates
(74) *Attorney, Agent, or Firm* — Haynes and Boone, LLP

(57) ABSTRACT

A system for deploying an untethered dissolvable frac package for use in a hydraulic fracturing operation includes a dissolvable or degradable frac package with a dissolvable or degradable setting tool. The setting tool of the dissolvable frac package is configured to deploy a dissolvable frac plug at a predetermined position along the wellbore string and dissolve over time in the wellbore.

20 Claims, 5 Drawing Sheets

Related U.S. Application Data filed on May 23, 2019, provisional application No. 62/852,153, filed on May 23, 2019, provisional application No. 62/852,161, filed on May 23, 2019.

(51) Int. Cl.

| | |
|---|---|
| ***E21B 43/116*** | (2006.01) |
| ***E21B 23/06*** | (2006.01) |
| ***E21B 33/129*** | (2006.01) |
| ***E21B 34/06*** | (2006.01) |
| ***E21B 43/117*** | (2006.01) |
| ***E21B 43/27*** | (2006.01) |
| ***E21B 33/13*** | (2006.01) |
| ***E21B 43/267*** | (2006.01) |

(52) U.S. Cl.

CPC ..... *E21B 33/1294* (2013.01); *E21B 33/13* (2013.01); *E21B 34/063* (2013.01); *E21B 43/116* (2013.01); *E21B 43/117* (2013.01); *E21B 43/267* (2013.01); *E21B 43/27* (2020.05); *E21B 2200/08* (2020.05)

(56) References Cited

U.S. PATENT DOCUMENTS

| | | | |
|---|---|---|---|
| 7,322,416 | B2 | 1/2008 | Burris, II et al. |
| 7,363,967 | B2 | 4/2008 | Burris, II et al. |
| 8,276,670 | B2 | 10/2012 | Patel |
| 8,342,094 | B2 | 1/2013 | Marya et al. |
| 8,496,052 | B2 | 7/2013 | Frazier |
| 8,677,903 | B2 | 3/2014 | Marya et al. |
| 9,133,695 | B2 | 9/2015 | Xu |
| 9,217,319 | B2 | 12/2015 | Frazier et al. |
| 9,464,508 | B2 | 10/2016 | Lerche et al. |
| 9,587,475 | B2 | 3/2017 | Frazier et al. |
| 9,671,201 | B2 | 6/2017 | Marya et al. |
| 9,695,677 | B2 | 7/2017 | Moody-Stuart et al. |
| 9,797,238 | B2 | 10/2017 | Frosell et al. |
| 9,920,621 | B2 | 3/2018 | Frosell et al. |
| 9,963,955 | B2 | 5/2018 | Tolman et al. |
| 10,082,008 | B2 | 9/2018 | Robey et al. |
| 2012/0152519 | A1 | 6/2012 | Rodgers et al. |
| 2013/0062055 | A1 | 3/2013 | Tolman et al. |
| 2013/0292174 | A1 | 11/2013 | Harvey et al. |
| 2014/0027127 | A1 | 1/2014 | Frazier et al. |
| 2015/0275643 | A1 | 10/2015 | Holder et al. |
| 2015/0345255 | A1* | 12/2015 | Onuoha ..... E21B 43/08 166/244.1 |
| 2016/0040520 | A1 | 2/2016 | Tolman et al. |
| 2017/0175500 | A1 | 6/2017 | Robey et al. |
| 2017/0234103 | A1 | 8/2017 | Frazier |
| 2017/0314372 | A1 | 11/2017 | Tolman et al. |
| 2018/0163503 | A1 | 6/2018 | Fripp et al. |
| 2018/0171744 | A1 | 6/2018 | Markel et al. |

FOREIGN PATENT DOCUMENTS

| | | | |
|---|---|---|---|
| WO | WO-2013184238 | A1 | 12/2013 |
| WO | WO-2018013131 | A1 | 1/2018 |

OTHER PUBLICATIONS

Korean Intellectual Property Office, PCT/US2020/032255, International Search Report and Written Opinion, dated Aug. 12, 2020, 17 pages, Korea.

Korean Intellectual Property Office, PCT/US2020/032257, International Search Report and Written Opinion, dated Aug. 20, 2020, 15 pages, Korea.

Korean Intellectual Property Office, PCT/US2020/032229, International Search Report and Written Opinion, dated Aug. 25, 2020, 12 pages, Korea.

* cited by examiner

DISSOLVABLE SETTING TOOL OR HYDRAULIC FRACTURING OPERATIONS

CROSS REFERENCE TO RELATED APPLICATIONS

This application is a U.S. national stage patent application of International Patent Application No. PCT/US2020/032255 filed on May 8, 2020, which claims priority to U.S. Provisional Application No. 62/852,129, filed May 23, 2019 entitled "Dissolvable Setting Tool for Hydraulic Fracturing Operations," the disclosure of which is hereby incorporated by reference. International Patent Application No. PCT/US2020/032255 also claims priority to U.S. Provisional Application Nos. 62/852,108 filed entitled "Locating Self-Setting Dissolvable Plugs", 62/852,153 entitled "Acid Fracturing with Dissolvable Plugs" and 62/852,161 entitled "Dissolvable Expendable Guns for Plug-and-Perf Applications", each filed on May 23, 2019, the disclosures of each of which are hereby incorporated by reference.

FIELD OF THE DISCLOSURE

This disclosure relates, in general, to equipment utilized in conjunction with operations performed in relation to hydraulic fracturing or stimulation of subterranean wellbores. In particular, the disclosure relates to systems and methods for deploying a frac plug for a hydraulic fracturing or stimulation operation.

BACKGROUND

After drilling each section of a subterranean wellbore that traverses one or more hydrocarbon bearing subterranean formations, individual lengths of metal tubulars are typically secured together to form a casing string that is positioned within the wellbore. This casing string provides wellbore stability to counteract the geomechanics of the formation such as compaction forces, seismic forces and tectonic forces, thereby preventing the collapse of the wellbore. Conventionally, the casing string is cemented within the wellbore. To produce fluids into the casing string, hydraulic openings or perforations are typically made through the casing string and establish communication to the formation.

A subterranean wellbore for hydraulic fracturing operations may include a vertical section, a transition section and a substantially long horizontal section. Once the sections of the wellbore are cased or lined, various downhole tools may be positioned in the wellbore to conduct downhole operations. For hydraulic fracturing operations, various downhole tools, such as frac plugs, setting tools, and perforation guns, may be positioned in the wellbore. The above-mentioned downhole tools may be deployed together on a tool string known as a frac package. Traditionally, the frac packages are conveyed into position in the wellbore using a service string, coil tubing or wireline. However, the use of service strings and/or wirelines lead to multiple challenges. For such frac package tools to perform their intended functions, they must be positioned in the wellbore at the proper depth and location along the casing string. Transitioning from the vertical section of the wellbore to the horizontal section of the wellbore using a service string or wireline, however, may be difficult due to, for example, lack of gravity as a conveyance means once the tool reaches the end of the vertical section of the wellbore. In addition, the deployment of a service string or wireline to lower the tool leads to rig downtime and added expense. As such, an alternative method of conveyance along the vertical and horizontal sections of the wellbore is needed.

After the hydraulic fracturing operation is complete the frac packages are then removed via another service string or wireline run, requiring another run downhole, or the frac package is left in the casing string. Removal of the frac package using a service string or wireline again requires an additional run downhole and leads to additional rig downtime. Alternatively, if the frac package is left in the casing string, it limits future wellbore operations during wellbore production.

DESCRIPTION OF ILLUSTRATIVE EMBODIMENTS

Figure 1:
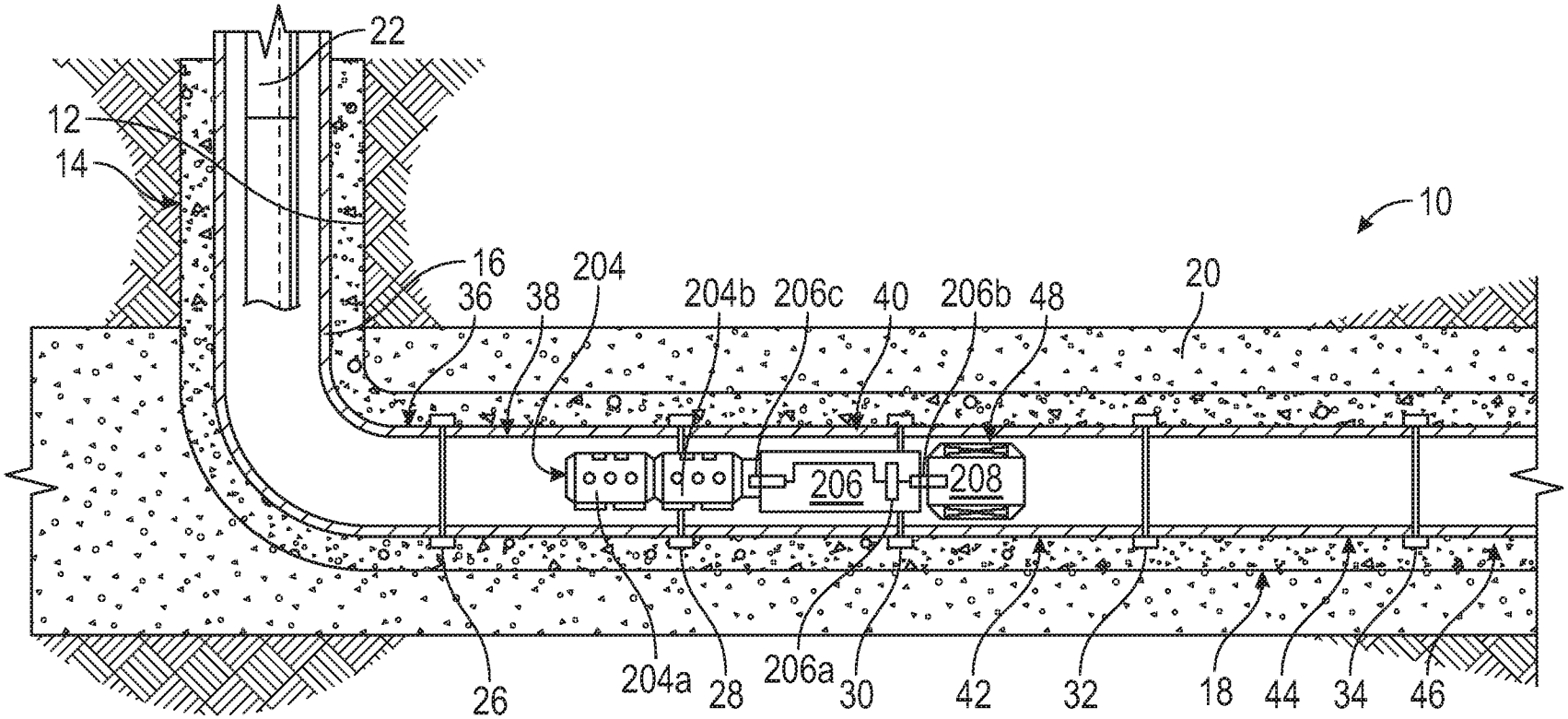
FIG. 1 is a cross-sectional schematic illustration of a wellbore system employing an untethered frac package, which includes a perforating gun, a setting tool and frac plug, each of which may be dissolved by wellbore fluids in accordance with one or more example embodiments of the present disclosure.

Embodiments of the present disclosure relate to deploying an untethered frac package in a casing string for a hydraulic fracturing or stimulation operation. The untethered frac package may be pumped downhole in a carrier fluid and dissolved in the wellbore once the hydraulic fracturing operation is complete, thereby eliminating the need of a service string or wireline for downhole placement and removal of the frac package.

Difficulties may arise transitioning from the vertical section of the wellbore to the horizontal section of the wellbore using a service string or wireline due to, for example, lack of gravity assistance in conveyance means once the tool reaches the end of the vertical section of the wellbore. In addition, the deployment of a service string or wireline to lower the tool leads to rig downtime and added expense. As such, an alternative method of conveyance, such as pumping an untethered frack package along the vertical and horizontal or just the highly deviated and horizontal sections of the wellbore would be helpful.

Once the frac packages have been properly positioned within the wellbore, they may require actuation from a first operating state to a second operating state, or may require actuation among various operating states. For example, a frac plug may require actuation from an unset configuration to set configuration. The untethered dissolvable frac packages of the present disclosure may eliminate difficulties in the actuation process for many downhole tools, which may involve tubing movement, tool movement, application of wellbore pressure, application of fluid flow, dropping of balls on sleeves, hydraulic pressure, electronic means or combinations of the above. Following the actuation process, confirmation of the actuation of the downhole tool may be desirable.

After the hydraulic fracturing operation is complete the untethered dissolvable frac packages may be dissolved in place, removing difficulties and expense of removing the frac packages via a service string or wireline, requiring another run downhole, or the difficulties associated with leaving frac package in the casing string. Removal of the frac package using a service string or wireline again requires an additional run downhole and leads to additional rig downtime. Alternatively, if the frac package is left in the casing string it limits future wellbore operations during wellbore production, intervention and/or other subsequent operations in the wellbore.

While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to implement such feature, structure, or characteristic in connection with other embodiments whether or not explicitly described.

It would also be apparent to one of skill in the relevant art that the embodiments, as described herein, can be implemented in many different embodiments of software, hardware, firmware, and/or the entities illustrated in the figures. Any actual software code with the specialized control of hardware to implement embodiments is not limiting of the detailed description. Thus, the operational behavior of embodiments will be described with the understanding that modifications and variations of the embodiments are possible, given the level of detail presented herein.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Illustrative embodiments and related methodologies of the present disclosure are described below in reference to FIGS. 1-7 as they might be employed. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

FIG. 1 is a schematic illustration of a wellbore system 10 in which an untethered dissolvable frac package 48 is deployed in a wellbore 12 according to an embodiment of the present disclosure. In the illustrated embodiment, the wellbore 12 extends through the various earth strata. Wellbore 12 has a substantially vertical section 14, and also has a substantially horizontal section 18 that extends through a hydrocarbon bearing subterranean formation 20. As illustrated in FIG. 1, a casing string 16 is cemented in both the vertical and horizontal sections 14, 18. In other embodiments, portions of the wellbore may be lined or open hole.

It will be appreciated by those skilled in the art that even though FIG. 1 depicts a substantially vertical section 14 and substantially horizontal section 18 of the wellbore 12, the embodiments described in the present disclosure are equally applicable for use in wellbores having other directional configurations including deviated wellbores, slanted wellbores, diagonal wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well.

Positioned within wellbore 12 and extending from the surface is an optional conveyance such as a tubing string 22, wireline, coiled tubing, etc. The frac package 48 is untethered from the tubing string 22. The frac package 48 may be lowered through the vertical section 14 on the tubing string 22 and untethered upon reaching the horizontal section 18. In other embodiments, the frac package 48 may be deployed untethered from the surface without the tubing string 22, wireline or other conveyance. Casing string 16 includes a plurality of couplings 26, 28, 30, 32, 34, which may be defined between individual lengths of metal tubulars in the casing string 16. Each of the couplings 26, 28, 30, 32, 34 comprises a passive depth marker which may be detected by the frac package 48 as it moves through the casing string 16 to provide an indication of the depth of the frac package 48 in the casing string 16. For example, each of the couplings 26, 28, 30, 32, 34 may include at least one array of magnets and each of which is positioned between potential frac package setting points 36, 38, 40, 42, 44, 46 thereby defining potential production intervals. In the illustrated embodiment, couplings 26, 28, 30, 32, 34 serve to locate and position the frac package 48. Each coupling 26, 28, 30, 32, 34 may include a unique magnetic signature, or otherwise provide a uniquely identifiable signal, and in some embodiments, each coupling 26, 28, 30, 32, 34 may include a similar magnetic signature or provide similar identifiable signal. In other embodiments, passive depth markers may include changes in material, physical surface features such as grooves or protrusions, or any other characteristic in the casing string 16 that may be detected by a controller 206*a*, sensor or another mechanism carried on the frac package 48 and from which a depth in the wellbore may be identified.

The frac package 48 includes a perforating gun section 204 at an upper end thereof, which may include one or more perforating guns 204*a*, 204*b*. In other embodiments, the perforating gun section 204 may be disposed at a different location within the frac package 48 without departing from the scope of the disclosure. A setting tool 206 is operably coupled between the perforating gun section 204 and a frac plug 208. As illustrated in FIG. 1, the setting tool 206 is physically coupled between the perforating gun section 204 and the frac plug 208. In other embodiments, the setting tool 206 or portions thereof may be carried by either the frac plug 208 or the perforating gun section without departing from the scope of the disclosure.

The setting tool 206 may include a controller 206*a* with a magnetic field detector for sensing the couplings 26, 28, 30, 32, 43, or other mechanism operable to detect a predetermined depth in the casing string 16. Once the controller 206*a* confirms that the frac package 48 has reached the appropriate predetermined depth, the controller 206*a* may provide a trigger signal to one or more actuators 206*b*, 206*c* in response to detecting the predetermined depth. The actuator 206*b* may release stored energy to provide an axial force through the frac plug 208 to induce the frac plug 208 to engage the casing string 16. The actuator 206*c* may induce the perforating guns 204*a*, 204*b* to fire, immediately, after a time delay or after confirmation that the frac plug 208 has engaged the casing string. The controller 206 may include a memory in which the particular operating instructions are stored.

As depicted, frac package 48 can be pumped along the horizontal section 18 in a conveyance fluid towards the toe of the wellbore 12. The conveyance fluid pumped into the wellbore 12 conveys the frac package 48 downhole. In some embodiments (not shown) a frac package may include radially extending tins to facilitate propelling the frac package with the fluid. The dissolvable frac package 48 senses the magnetic signature or other signal produced by each coupling 26, 28, 30, 32, 34, and the setting tool 206 within the frac package 48 sets the frac plug 208 at a predetermined location in relation to set point positions 36, 38, 40, 42, 44, 46 thereby defining the perforation points along the wellbore 12. As illustrated in FIG. 1, the perforating gun section 204 is illustrated as being pumped downhole along with the setting tool 206 and the frac plug 208. In other embodiments, the perforating gun section 204 may be deployed separately, e.g., by wireline or service line, once the frac plug 208 has been set.

Figure 2:
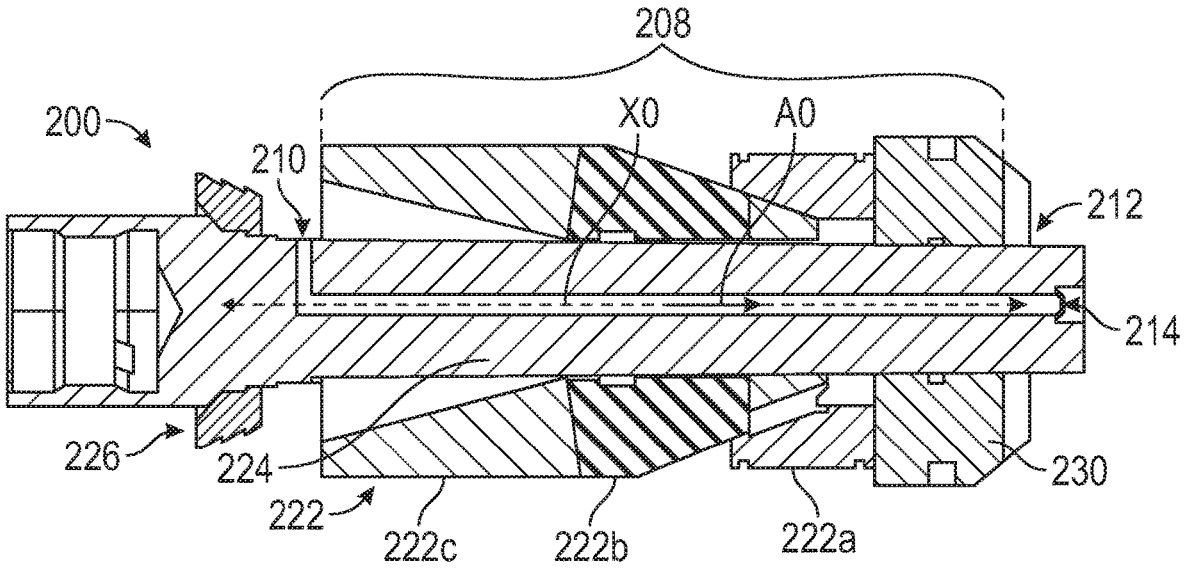
FIG. 2 is a cross-sectional view of an example setting tool that may be employed in the frac package of FIG. 1, which illustrates a bottom-set arrangement of the setting tool with a bypass line extending through the setting tool.

Referring to FIG. 2 a dissolvable, setting tool 200 is illustrated, which may be employed as the setting tool 206 of FIG. 1. The dissolvable setting tool 200 may be employed to set a pressure holding structure 222 of a bottom-set frac plug 208. The pressure holding structure 222 may include a slip 222*a*, slip wedge 222*b* and a seal element 222*c* in a bottom-set arrangement with a mandrel 224 of the frac plug 208 extending therethrough. In a bottom-set arrangement, as shown in FIG. 2, the mandrel 224 is placed in tension while the slip 222*a*, slip wedge 222*b* and a seal element 222*c* of the frac plug 208 are placed in compression to set the frac plug 208. For example, when the setting tool 200 detects a predetermined depth in the casing string 16, the setting tool 200 provides a trigger signal to cause the mandrel 224 to move in the axial direction of arrow A0 with respect to the slip wedge 222*b* and a mule shoe 230. The slip 222*a* is drawn up the slip wedge 222*b* and consequently moves radially outwardly to grip the casing string 16 (FIG. 1). The seal element 222*b* is axially compressed between the slip wedge 222*b* and an upper wedge 226 that may be drawn into the seal element 222*c* (see, e.g., FIG. 5B). The seal element 222*c* expands radially outwardly to form a seal with the casing string 16.

Dissolvable bottom-set setting tool 200 may include a bypass passage 210 that runs longitudinally along the central axis X0 of the setting tool 200 towards a distal bottom end 212. Located at the distal end of the bypass passage 210 is a pressure relief valve 214. The pressure relief valve 214 can be any one of a number of pressure relief mechanisms such as a rupture disc, pop-off valve, check valve, flow restriction, plug with shear pin, et. cetera. The bypass passage 210 may facilitate replacement of a failed frac package 48 (FIG. 1). Under certain conditions, a frac plug 208 may be set and an associated perforating gun 204*a*, 204*b* (FIG. 1) may fail to fire. Under these conditions, with the frac plug 208 set, it would be difficult to pump down another frac package 48 to replace the failed frac package 48. To address this problem, the dissolvable setting tool 200 may include pressure relief valve 214 on bypass line 210. In the event that the perforating gun section 204 fails to fire, pressure can be applied above the pressure relief valve 214 to rupture the pressure relief valve 214 and allow fluid to bypass the frac plug 208 through the bypass passage 210. This allows for acid and other solvents to be circulated past the distal end 212 to accelerate dissolution of the frac plug 208 so that a replacement frac package 48 can be run into the wellbore 12 and pumped downhole. It should be apparent that the bypass passage 210 may alternatively be arranged along an axis other than the central axis X0, and the bypass passage 210 may be disposed through the frac plug 208 rather than the setting tool 200. The pressure relief valve 214 may be positioned anywhere along a flow path defined through the bypass passage 210. In other embodiments (not shown), a setting tool may be pulled clear or otherwise separate a frac plug to facilitate dissolving of a frac plug and/or the setting tool.

Figure 3:
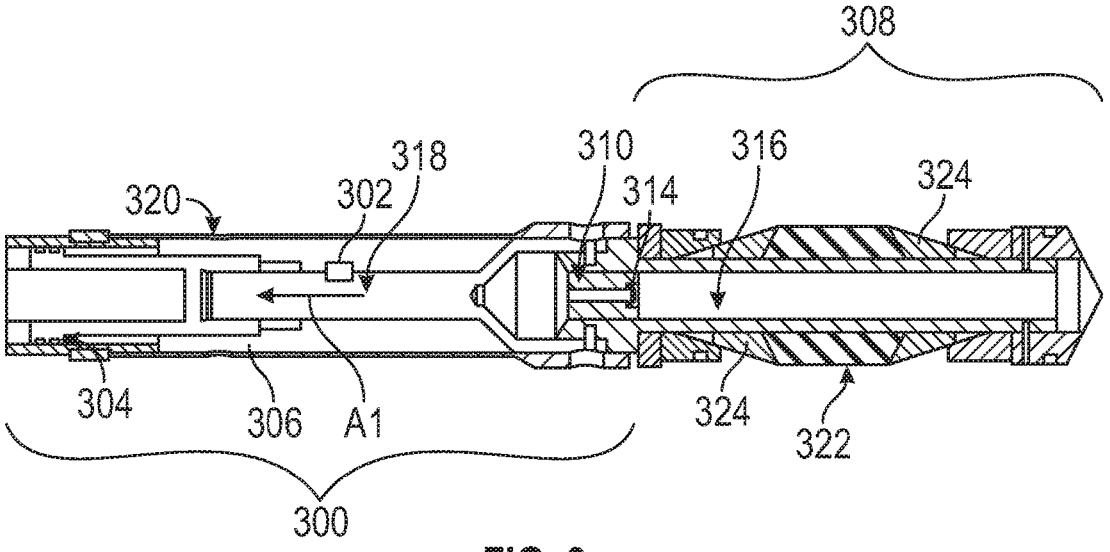
FIG. 3 is a cross-sectional view of another example setting tool, which illustrates a top-set arrangement of the setting tool with a bypass line.

In another embodiment, as illustrated in FIG. 3, a dissolvable setting tool 300 may be configured as a top-set setting tool. During operation, the top-set setting tool 300 may release energy stored in a hydraulic or atmospheric chamber 318 to place a mandrel 316 of frac plug 308 in tension. For example, when the setting tool 300 detects a predetermined depth in the casing string 16 (FIG. 1), the setting tool 300 provides a trigger signal to an actuator 302 to release a pressurized hydraulic fluid from the chamber 318. The actuator 302 may include a solenoid valve or similar mechanism responsive to the trigger signal to release the hydraulic fluid. Once released, the hydraulic fluid may apply pressure to a piston 304 within an annular chamber 306 to draw the mandrel 316 with the chamber 318 in the direction of arrow A1 with respect to a housing 320. The mandrel 316 may thereby be placed in tension, axially compressing a seal element 322 of the frac plug 308 between upper and lower slip wedges 324. The axial compression of the seal element 322 causes the seal element 322 to radially expand into contact with the surrounding casing string 16 (FIG. 1) to set the frac plug 308.

The top-set setting tool 300 is provided with a bypass passage 310 and pressure relief mechanism 314. Pressure above an activation pressure can be applied to pressure relief mechanism 314 to allow fluid to bypass the frac plug 308 through bypass passage 310. The bypass passage 310 may be fluidly coupled to an exterior of the setting tool 300 to permit an activation fluid to be pumped into the wellbore 12

(FIG. 1) to be applied to the pressure relief valve 314. Once the pressure relief valve 314 is activated, fluid may be flowed through the bypass passage 310 to act on the interior of a seal element 322 and/or from below the seal element 322.

Figure 4:
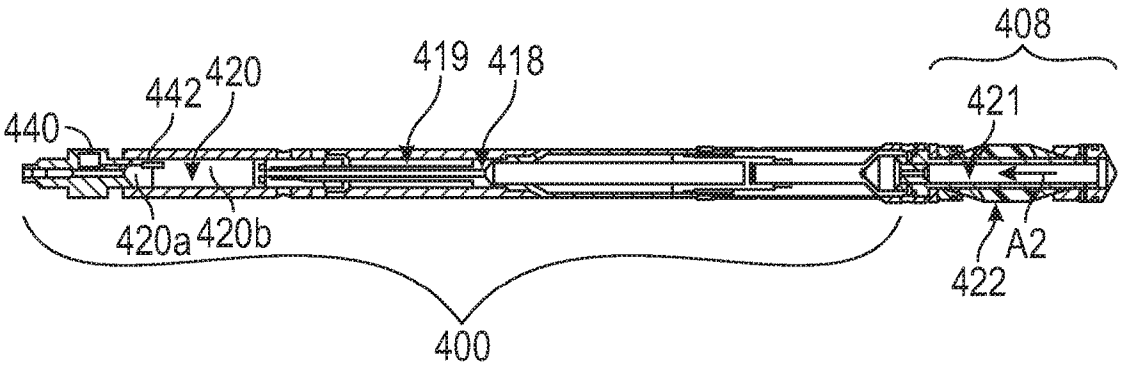
FIG. 4 is a cross-sectional view of another example setting tool, which illustrates a chemical activation mechanism for setting a frac plug.

In another embodiment, as illustrated in FIG. 4, a top-set setting tool 400 may employ gas generation from a chemical reaction to set a frac plug 408. Chemical components 420*a* and 420*b* used to generate the gas may be stored separately in chemical chamber 420. Once triggered by a controller 440, an actuator 442 permits the chemical components 420*a*, 420*b* to combine and react in the chemical chamber 420. The actuator 442 may include, e.g. a needle to puncture a barrier between the chemical components. A product of a chemical reaction between the chemical components may be a gas, which may be released into hydraulic chamber 418. The gas generates pressure in the hydraulic chamber 418 until the pressure in hydraulic chamber 418 exceeds the pressure in a blind chamber 419. A piston in the hydraulic chamber coupled to a mandrel 421 may then be moved in the direction of the blind chamber 419. In some embodiments, the blind chanter 419 may be exposed to the hydrostatic pressure, such that the mandrel 421 is induced to move in the direction of arrow A2 when the pressure in hydraulic chamber 418 exceeds the hydrostatic pressure. The pressure in the hydraulic chamber 418 thereby creates a setting force to axially compress frac plug 408 and engage the seal element 422 with the casing string 16 (FIG. 1).

Figure 5A:
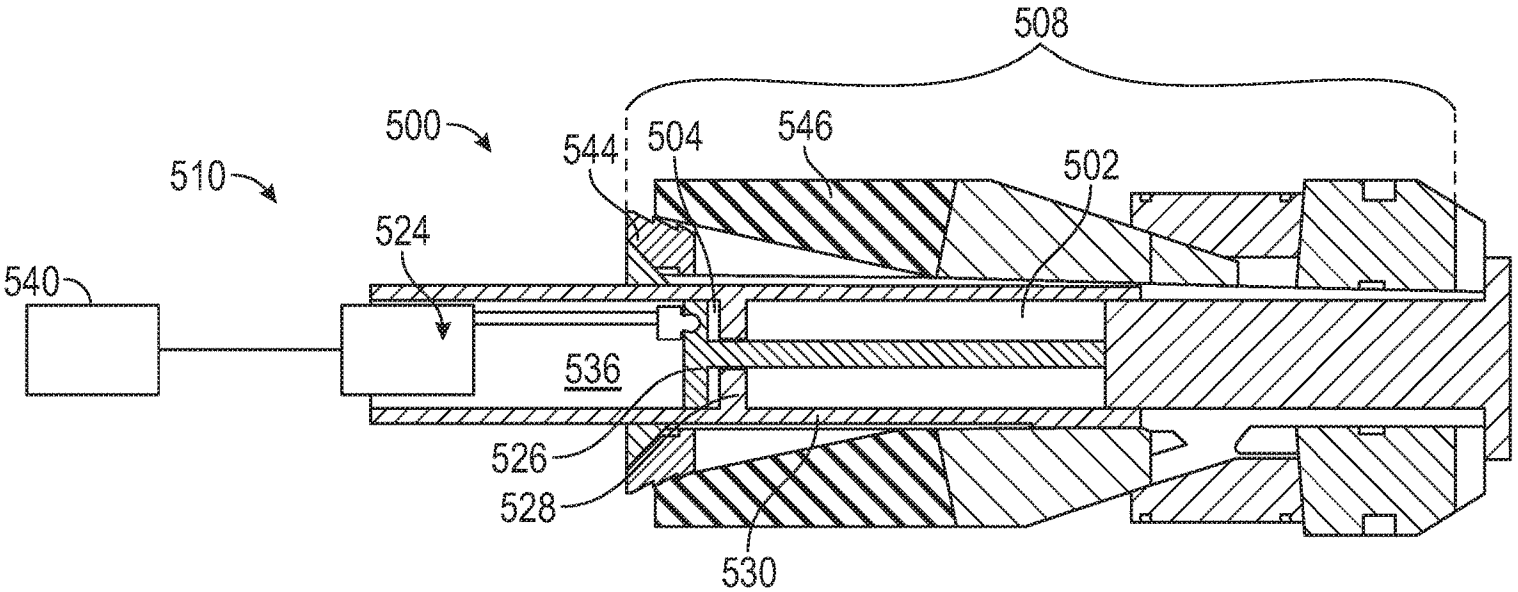
FIGS. 5A and 5B are cross-sectional views of another example of a setting tool including an air chamber upon which hydrostatic pressure may act to move the setting tool from a first unset configuration (FIG. 5A) to a second set configuration (FIG. 5B).

In another embodiment, as illustrated in FIG. 5A, the setting energy for a dissolvable setting tool 500 is stored air chambers 502, 504. The air chambers 502, 504 may be assembled at the surface in a first configuration (FIG. 5A) such that ambient air at atmospheric pressure is contained therein. Air chamber 504 is defined axially between a plug 526 and a piston 528. The plug 526 seals with a tubular mandrel 530 to fluidly isolate the air chamber 504 from a hydrostatic chamber 536 that is open to hydrostatic pressure when the setting tool is deployed in a wellbore 12 (FIG. 1). The piston 528 is coupled to the tubular mandrel 530 such that the tubular mandrel 530 moves with the piston 528.

A trigger assembly 510 is provided to selectively allow the hydrostatic pressure from hydrostatic chamber 536 to enter air chamber 504. The trigger assembly 510 includes an actuator 524 operably coupled to a controller 540. The actuator 524 may be operable to selectively rupture the plug 526 when the frac plug 508 is in the desired location. When the controller 540 determines that the frac plug 508 has reached an appropriate depth in the wellbore 12, for example, the controller 540 may provide a trigger signal to the actuator 524 to induce the actuator 524 to open a fluid path through the plug 526. In some embodiments, the actuator 524 may include a shaped explosive charge directed at the plug 526 that may be discharged in response to the trigger signal. Discharging the shaped charge may rupture the plug 526 to create a fluid opening 542 (FIG. 5B) through the plug 526, which permits the pressure between the hydrostatic chamber 536 and the air chamber 504 to equalize at the hydrostatic pressure. In other embodiments, the trigger assembly 510 may include an electronic rupture disc, a fusible material, or a frangible material.

Figure 5B:
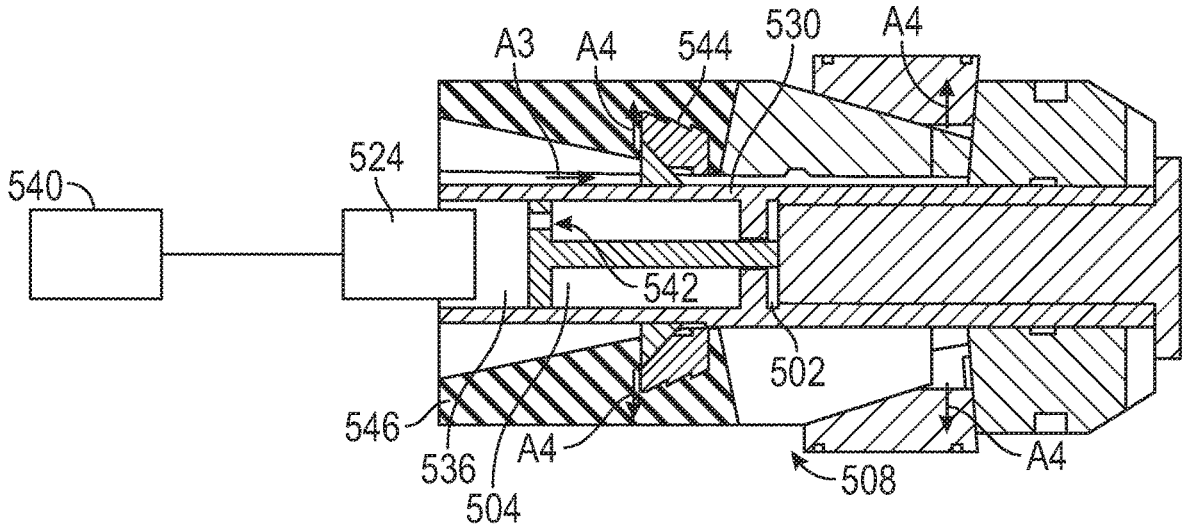

As illustrated in FIG. 5B, with the fluid chamber 504 at the hydrostatic pressure and the air chamber 502 at the surface ambient atmospheric pressure, the differential pressure between chambers 504 and 502 create a large force for setting the frac plug 508. The hydrostatic pressure is applied to the piston 528 driving the tubular mandrel 530 in the axial direction of arrow A3. The tubular mandrel 530 carries an upper wedge 544 into a seal element 546 of the frac plug 508, generally placing the frac plug 508 in compression in a bottom set arrangement. The frac plug 508 is thereby moved to a set position with slips 548 and the seal element 546 moving to a radially outward configuration or position in the radial direction of arrows A4. The frac plug 508 may thus be set to engage a casing string 16 (FIG. 1), and thereafter the setting tool 500 may be dissolved in the wellbore.

Figure 6A:
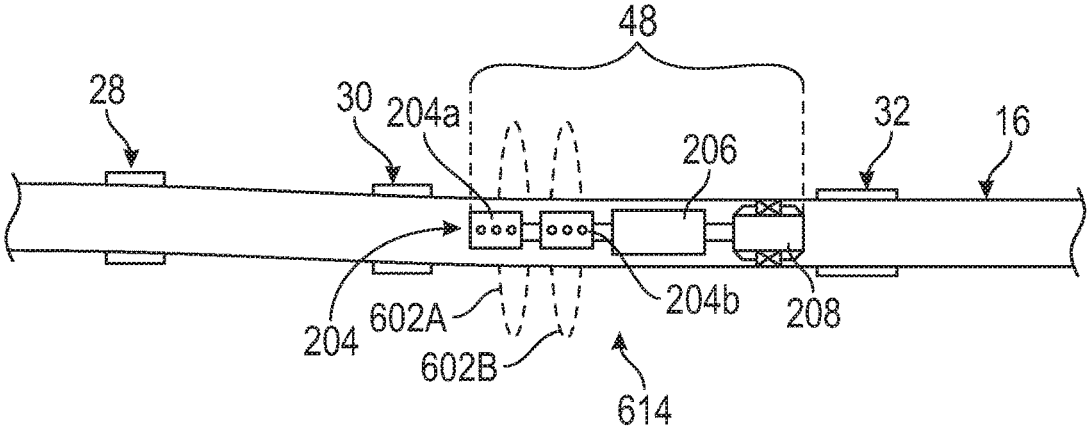
FIG. 6A is a cross sectional view of the untethered frac package of FIG. 1 illustrated in the wellbore wherein the perforating gun has been fired and the frac plug has been set.

FIG. 6A illustrates the frac package 48 of FIG. 1 employed in an example hydraulic fracturing or stimulation operation. The dissolvable frac package 48 is pumped through the casing string 16 until reaching a predetermined target depth. In response to encountering the coupling 30, for example, the setting tool 206 may trigger the perforating guns 204*a*, 204*b* in perforating gun section 204 to fire and perforate the casing string 16. In some embodiments, the controller 206*a* (FIG. 1) of the setting tool 206 may be preprogrammed to trigger the perforating guns 204*a*, 204*b* immediately upon reaching the coupling 30, and in other embodiments, the setting tool 206 may be preprogrammed to trigger the perforating guns 204*a*, 204*b* after a predetermined time delay has elapsed after encountering the coupling 30. Each set of perforating guns 204*a*, 204*b* in the perforating gun section 204 may be triggered at a different time so that a first perforation cluster 602A may be created earlier than a second perforation cluster 602B, which can result in perforation clusters 602A, 602B being formed while the frac package 48 is being pumped into the wellbore. Once the perforating guns 204*a*, 204*b* in perforating gun section 204 have fired, the setting tool 206 may also instruct the actuator 206*b* (FIG. 1) to cause the frac plug 208 to set. The frac plug 208 fluidly isolates the lower frac zones and individual frac stages.

Once the perforation clusters 602A, 602*b* are generated and the frac zones isolated, hydraulic fracturing or stimulation can occur. The hydraulic fracturing or stimulation of the perforations can be performed with proppant, with acidized fluids or solvents, or with a combination of acid, solvent and proppant. In one embodiment, the hydraulic fracturing of the perforation clusters can be performed with a combination of both proppant and acid.

The setting tool 206 and the frac guns 204*a*, 204*b* may dissolve prior to, during or after the fracturing or stimulation operation. Once the hydraulic fracturing operation is completed, the entire frac package 48 or any remaining portions thereof may degrade in the wellbore fluids. In one embodiment, the perforating guns 204*a*, 204*b*, setting tool 206, and frac plug 208 degrades in water-based fluids. In another embodiment, the frac package 48 degrades in an acid-based fluid. In one embodiment, the majority of the mass from each of the components in the frac-package 48 degrades into individual particles less than one half inch diameter. In some embodiments, the frac package 48 is composed of multiple materials that degrade in different fluids and at different rates. The frac plug 208 needs to have structural integrity for the duration of the stimulation treatment while the perforating gun 204 and the setting tool 206 are no longer needed once the fracturing or stimulation operation starts. As a result, the frac plug 208 can be constructed from materials that degrade more slowly in water or acid while the perforating gun and setting tool are constructed from materials that degrade more rapidly in water or acid. For example, the perforating gun section 204 and the setting tool 206 may be composed of a degradable metal while the frac plug 208 is made of a combination of degradable materials such as ceramics, plastics, and elastomers. In proppant-based hydraulic fracturing, the hydraulic fracturing is process may start with acid then transition to majority proppant. In an acid-based hydraulic fracturing process acid is used extensively. By constructing the perforating gun section 204 and the setting tool 206 from degradable metal, the acid will accelerate the degradation of these two frac package components 204, 206 at a faster rate than the frac plug 208. As a result, the perforating gun section 204 and the setting tool 206 will degrade early in the hydraulic fracturing or stimulation operation. The plastic and elastomer materials in the frac plug 208 are more resistant to acid and, therefore, will last longer during the hydraulic fracturing or stimulation operation and provide diversion. Example inorganic acids, which may be employed in a stimulation treatment and/or to degrade portions of the frac package 48, include HCl and phosphoric acid. Example organic acids may include carboxylic acids, citric acid, lactic acid, formic acid, acetic acid.

The setting tool 206 and frac plug 208, or any of the other setting tools 300, 400, 500 and frac plugs 308, 408, 508 described herein, may include of multiple components where each component may be constructed from a dissolvable plastic, dissolvable rubber, dissolvable metal, and/or other non-dissolvable material. For example, the mandrels, frac balls (not shown), upper slips, upper wedges, and mule shoes could all be constructed from a fiber-reinforced dissolvable plastic. The frac plug elements may be constructed from a dissolvable elastomer, a dissolvable plastic, or a dissolvable metal. The lower wedges and lower slips could be constructed from a dissolvable metal. Constructing the lower wedges and lower slips from a dissolvable metal is advantageous because the metals are stronger than the plastic and the lower slips support the hydraulic forces on the plug. The slips may include teeth that bite into the casing string 16, which can be constructed from non-dissolvable material, such as ceramic or hardened steel, in some embodiments, the plug element is composed of a degradable elastomer, while the setting wedge, and mule shoe are composed of a degradable plastic, and the lower wedge and lower slips are composed of a degradable metal, while the teeth are composed of a non-degradable material. In some embodiments, the tensile components of the setting tool, e.g., the mandrel in a top set arrangement, could be composed of a degradable metal while other components, e.g., the slips, wedges and seal elements, which are placed in compression, are constructed of a combination of degradable metals, degradable plastics, and degradable elastomers.

The degradable plastic material may be one of aliphatic polyesters such as poly (lactic acid) (PLA) and poly (glycolic acid) (PGA). The degradable elastomer material may be one of polyurethane, thermoplastic urethane (TPU), and thiol. The degradable metal may be one of magnesium and aluminum alloys. The non-degradable materials may be one of steel, brass, ceramic, and cast iron. In one embodiment, the degradable materials may be coated with a protective layer, e.g., with a metal coating such as nickel, to inhibit the degradation process until degradation is warranted. Types of coatings may be one of metal-based and/or polymer-based materials.

As used herein, dissolvable materials are materials that may be dissolved or otherwise broken down by application of a selected wellbore fluid in a period of time, without destroying other downhole components made of other materials that are also contacted by the selected wellbore fluid in that same period of time. The parts made of such dissolvable materials may be effectively removed from service by dissolution or degrading, preferably without a need to retrieve them from the wellbore, within a practical period of time such as within days or even minutes of exposure to the selected wellbore fluid. In some embodiments, the components described as "dissolvable" may degrade within 2 weeks of exposure to the selected wellbore fluids such that individual particles remaining are less than about one half inch diameter.

Non-limiting examples of a "dissolvable material" or a "degradable material" include at least hydrolytically degradable materials such as elastomeric compounds that contain polyurethane, aliphatic polyesters, thiol, cellulose, acetate, polyvinyl acetate, polyethylene, polypropylene, polystyrene, natural rubber, polyvinyl alcohol, or combinations thereof. Aliphatic polyester has a hydrolysable ester bond and will degrade in water. Examples include polylactic acid, polyglycolic acid, polyhydroxyalkonate, and polycaprolactone. A "dissolvable material" may also include metals that have an average dissolution rate in excess of 0.01 mg/cm2/hr. at 200° F. in a 15% KCl solution. A component constructed of a dissolvable material may lose greater than 0.1% of its total mass per day at 200° F. in a 15% KCl solution. In some embodiments, the dissolvable metal material may include an aluminum alloy and/or a magnesium alloy. Magnesium alloys include those defined in ASTM standards AZ31 to ZK60. In some embodiments, the magnesium alloy is alloyed with a dopant selected from the group consisting of iron, nickel, copper and tin. A solvent fluid for a dissolvable material may include water, a saline solution with a predetermined salinity, an HCl solution and/or other fluids depending on the selection and arrangement of components constructed of the dissolvable material.

Figure 6B:
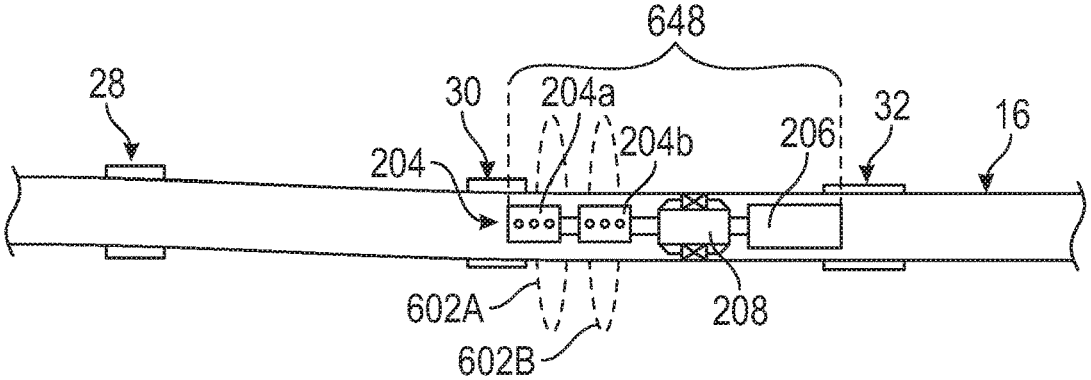
FIG. 6B is a cross sectional view of an alternate untethered frac package wherein a setting tool coupled to a lower end of frac plug and a perforating gun is coupled to an upper end of the frac plug, and wherein the perforating gun has been fired and the frac plug has been set.

As illustrated in FIG. 6B, an alternate frac package 648 is illustrated wherein the setting tool 206 is coupled to a lower end of the frac plug 208 and the perforating gun section 204 is coupled to an upper end of the frac plug 208. Since the setting tool 206 is responsive to detecting the coupling 30, for example, the setting tool 206 may operate from upper or lower ends of the frac plug 208. This arrangement permits a closer spacing of the clusters 602A and 602B to the frac plug 208.

Figure 7:
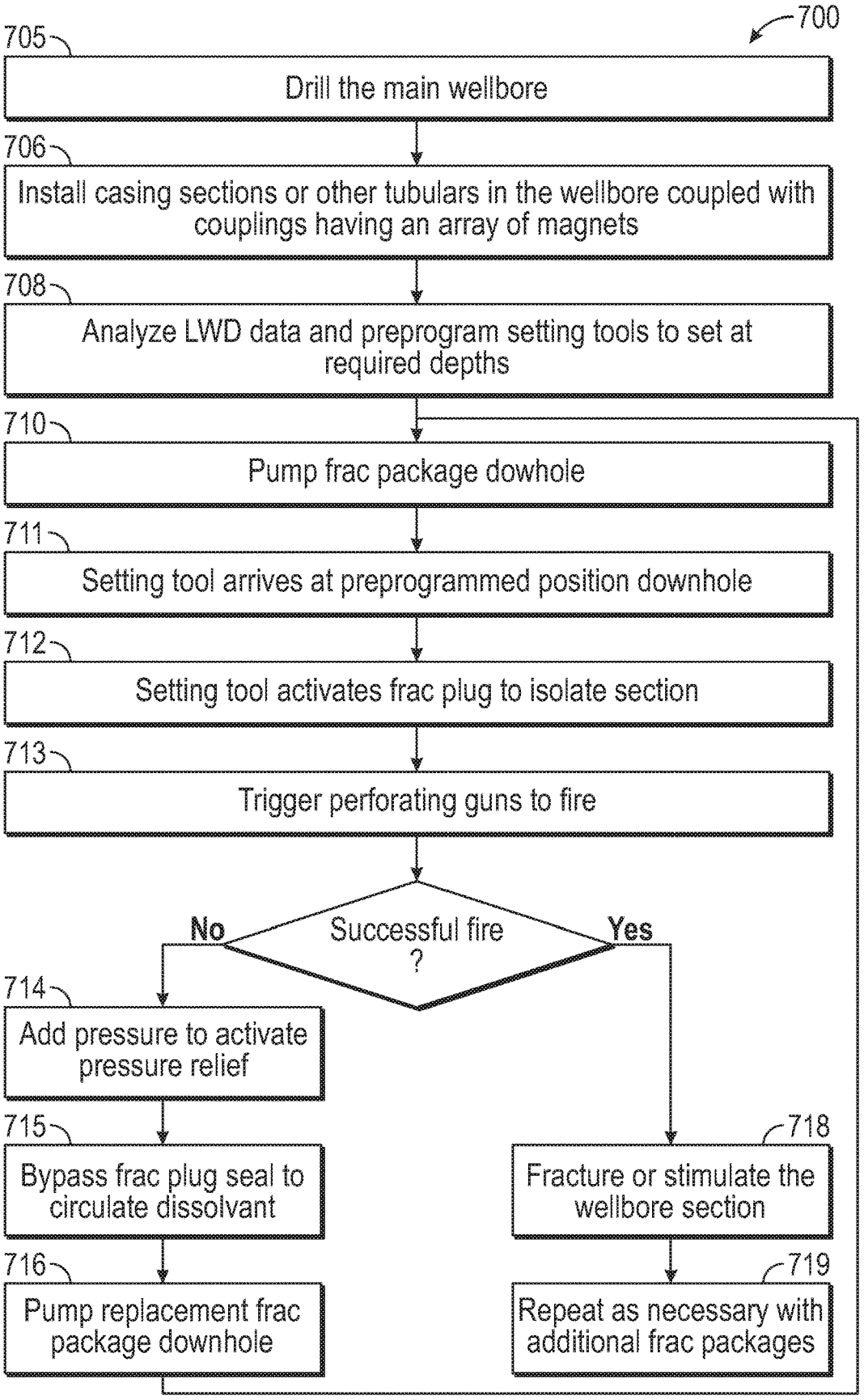
FIG. 7 is a block diagram illustrating a process of deploying the untethered dissolvable frac package downhole and performing a hydraulic fracturing operation.

FIG. 7. is a block diagram illustrating a procedure 700 used to deploy an dissolvable setting tool into a wellbore 12 and perform a hydraulic fracturing or stimulation operation of wellbore 12. First, in step 705, the main wellbore 12 is drilled. All or a portion of the wellbore 12 is then cased and cemented in step 706. In some embodiments, the entirety of the wellbore 12 length is cased and completed where the casing string 16 contains the couplings 26, 28, 30, 32, 34 and associated array of magnets for each coupling. In other embodiments, other types of wellbore tubulars may be preconfigured with the couplings 26, 28, 30, 32, 34 and associated array of magnets, or other passive depth markers detectable by the controller 206*a* of the setting tool 206. In step 708, logging while drilling (LWD) or other data may be analyzed to determine appropriate wellbore locations for the frac plug 208 to be set and for perforations to be formed. The controller 206*a* of the setting tool 206 of one or more frac packages 48 may be preprogrammed to set provide a trigger signal to the actuators 206*b*, 206*c* of the setting tool 206 at the appropriate depths in response to detecting one or more of the magnetic couplings 26, 28, 30, 32, 34. In step 710, the untethered dissolvable frac package 48 is pumped downhole.

In step 711, the dissolvable frac package 48 arrives at a predetermined set point position based on the preprogrammed depth programmed into the controller 206*a* of the setting tool 206. In some embodiments, the controller 206*a* of the setting tool 206 counts the number of times an array of magnets is passed and sets the tool once a certain count is reached. In step 712, the controller 206*a* of the setting tool 206 issues a trigger signal to the actuator 206*b* of the setting tool 208 to activate the seal element 222*c* of the frac plug 208 to isolate the fracture section. The successful deployment of the frac plug 208 and engagement of the frac element with the inner wall of the casing string 16 may be determined by monitoring the wellbore 12 fluid pressure. In step 713, the setting tool 206 fires the perforation gun 204, e.g., by issuing a trigger signal to the actuator 206. If the perforation gun 204*a*, 204*b* successfully fires, then the procedure advances to step 718. If it is detected that the perforation gun 204*a*, 204*b* fails to fire in response to being triggered to fire, then the procedure 700 proceeds to step 714. In step 714, pressure is added above the pressure relief valve 214 to activate the pressure relief valve 214. This allows a dissolvent fluid to bypass the set frac plug 208 and circulate of both sides of the set frac plug 208 in step 715, thus, accelerating degradation of the frac plug 208. In step 716, after the original frac package 48 is dissolved, a replacement frac package 48 is pumped downhole (return to step 710 and repeat the process). If at step 713 the perforation gun fires, then next is step 718, where the previously perforated and isolated sections in the wellbore 12 are hydraulically fractured or stimulated with a proppant, acid, or combination of proppant and acid. In step 719, the process is repeated starting at step 710 for multiple frac stages. After the final fracture stage is complete the frac packages remain downhole and are allowed to dissolve over time.

As described above, embodiments of the present disclosure are particularly useful for deploying an untethered dissolvable frac package and locating a position downhole along the wellbore string. Accordingly, advantages of the present disclosure include a reduction in the time between stimulation stages which allows for greater efficiency in the stimulation process. The use of a dissolvable frac package where the frac plug is only slowly dissolvable in the acid stimulation allows for using dissolvable components in an acid stimulation. Some dissolvable metal frac plugs may dissolve too rapidly in acid for acid stimulation operations to be completed, while some non-fiber reinforced plastic frac plugs may lack the mechanical strength for stimulation treatments. The combined system that uses a dissolvable metal perforating and a dissolvable fiber-reinforced polymer frac plug allows for a removable frac package that does not need wireline intervention.

In a first aspect, the present disclosure is directed to a dissolvable frac package for deployment in the casing string along a wellbore. The dissolvable frac package is operable to be pumped along both the vertical and horizontal sections of the wellbore. The dissolvable frac package includes a dissolvable setting tool configured to create a setting force within the casing sting. In one embodiment, the dissolvable setting tool uses a hydraulic chamber to create the setting force. In another embodiment, the setting tool creates a setting force by pressure acting on an atmospheric chamber. In another embodiment, the setting tool creates a setting force by using a gas generating chemical that is activated when the hydraulic chamber exceeds hydrostatic pressure. The dissolvable frac package also consist of a dissolvable frac plug and plug element that has, at least, a first position and second position relative to the dissolvable setting tool of the dissolvable frac package. During the hydraulic fracturing plug-and-perforate stage, the frac plug needs to be set. In one embodiment, the dissolvable setting tool uses an electrical trigger to actuate the frac plug and plug element from the first position to the second position. The setting tool electrical trigger releases stored energy to provide an axial force through the setting tool. The axial force radially expands the plug element creating a fluid sealable contact with the casing string inner wall. In one embodiment, the setting tool is in the form of a bottom-set setting tool. In another embodiment, the setting tool is in the form of a top-set setting tool. In yet another embodiment, the setting tool is in the form of both a top-set and bottom-set setting tool. In the first position, the plug element is retracted. In the second position, the plug element is extended to make fluid sealable contact with the inner casing wall. In one embodiment the plug element moves radially outward towards the inner wall of the string relative to the setting tool of the frac package. In another embodiment, the plug element moves circumferentially relative to the setting tool of the frac package and extends radially outward towards the inner wall of the string. In a particular embodiment, the frac plug and plug element may have a plurality of positions relative to the setting tool of the frac package between the first and second positions such that a different degree of engagement with the inner casing wall is produced in each of the plurality of positions.

Once the dissolvable frac plug is set and the wellbore perforated, the next step in the hydraulic fracturing process takes place. The next step in the hydraulic fracturing process consists of pumping a large volume of fluid and proppant downhole to expand the fractures previously generated during the plug and perforate stage. This process is known as a proppant-based frac. In another embodiment, large volumes of acid are pumped downhole for an acid-based frac. In yet another embodiment, a combination of proppant and gelled acid is pumped downhole in a process called combo frac. The dissolvable setting tool is constructed from degradable materials capable of being dissolved in an aqueous solution. In one embodiment, the dissolvable setting tool degrades in water-based fluids. In another embodiment, the dissolvable setting tool degrades in an acid-based fluid. The majority of the mass from the setting tool must degrade. In one embodiment, the degraded setting tool may transform into a volume of broken particles with a tensile strength less than 100 psi and individual particle size of less than a half inch diameter.

In a second aspect, the present disclosure is directed to a method to deploy the dissolvable frac package into the wellbore. The method includes lowering the frac package, via wireline to a distill end of the vertical section of the wellbore. Once the distill end of the vertical section of the wellbore is reached the wireline cable is detached and the now untethered dissolvable frac package is further pumped along the horizontal section of the wellbore. While the frac package is being pumped along the horizontal section of the wellbore the magnetic field detector senses the magnetic fields produced by each array of magnets deployed along the string. Once the frac package reaches a predetermined position along the string, the setting tool senses the magnetic field produced by the array of magnets and sets the frac plug. When the frac plug is deployed it creates fluid sealable contact with the inner wall of the string. Successful deployment and engagement of the frac plug with the inner wall of the string is confirmed by anticipated fluid backpressure production in the wellbore. In another embodiment, successful deployment and engagement of the frac plug with the inner string wall is confirmed by a confirmation signal sent by a transceiver element located in the frac package setting tool.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

While specific details about the above embodiments have been described, the above hardware descriptions are intended merely as example embodiments and are not intended to limit the structure or implementation of the disclosed embodiments In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In one aspect, the disclosure is directed to a wellbore system useful in hydraulic fracturing or stimulation operations. The system includes: a wellbore string extending into a subterranean wellbore; a frac plug including a seal element movable from a first radially inward position to a second radially outward position to engage the wellbore string in response to movement to the second radially outward position; a dissolvable setting device including an actuator operably coupled to the frac plug to selectively move the seal element from the first position to the second position in response to receiving a trigger signal, the dissolvable setting device constructed of dissolvable materials such that the dissolvable setting device degrades into individual particles less than one half inch diameter in wellbore fluids and or acid; and a controller carried by the dissolvable setting tool, the controller operable to detect a predetermined depth in the wellbore string, and to provide the trigger signal to the actuator in response to detecting the predetermined depth.

In one or more embodiments, the wellbore system includes a bypass passage extending at least partially through the frac plug, the bypass passage being open to receive a fluid from above the frac plug when the seal element is in the second position in the wellbore string. The bypass passage may be fluidly coupled with a pressure relief valve, the pressure relief valve operable to prevent flow through the bypass passage until activated and permit flow through the bypass passage once activated. The pressure relief valve may be one of a pop-off valve or rupture disc.

In some embodiments, the wellbore system further includes a perforating gun section coupled permanently or temporarily to the setting tool and frac plug, wherein the perforating gun section, frac plug, and setting tool are each constructed at least partially of a dissolvable material. The frac plug may be operationally coupled to a upper end of the setting tool and the perforating gun operationally coupled to an upper end of the frac plug.

In some embodiments, the actuator of the setting tool may include a hydraulic chamber and a piston movable in response to a change in pressure in the hydraulic chamber to move the frac plug from the first radially inward position to the second radially outward position. The hydraulic chamber of the setting tool may be an air chamber at a surface atmospheric pressure, and the actuator may be selectively operable to open a fluid path the air chamber and a hydrostatic chamber at hydrostatic pressure. The actuator of the setting tool may include a chemical chamber that houses chemical components selectively reactive with one another to produce a gas into the hydraulic chamber.

In one or more embodiments, the setting tool is a top-set setting tool operable to place a mandrel of the frac plug in tension to move the seal element to the second position and to move slips along a slip wedge, wherein the mandrel of the frac plug is constructed of a dissolvable metal, slip wedges are constructed of a degradable plastic, and wherein the seal element is constructed of a degradable elastomer. In some embodiments, the setting tool is a bottom-set setting tool operable to place a mandrel of the frac plug in compression. In some embodiments, the wellbore string is one of a tubular, a casing, a drill string, and/or a liner.

In another aspect, the disclosure is directed to a method for hydraulic fracturing or stimulation operations in a wellbore. The method includes: deploying a frac package into a wellbore string in the wellbore; detecting a predetermined depth in the wellbore string with a controller of a setting tool carried by the frac package; providing a trigger signal to an actuator of the setting tool in response to detecting the predetermined depth; moving a seal element of a frac plug carried by the frac package with the actuator in response to receiving the trigger signal, wherein moving the seal element engaging the seal element with the wellbore string to fluidly isolate a perforation zone in the wellbore; pumping a fluid into the perforation zone isolated by the frac plug to hydraulically fracture or stimulate the wellbore; and degrading the setting tool into individual particles less than one half inch diameter in wellbore fluids in the wellbore.

In one or more embodiments, the method further includes triggering a perforating gun carried by the frac package to fire subsequent to engaging the seal element with the wellbore string. In some embodiments, the method further includes detecting a failure of the perforating gun to fire in response to being triggered to fire, and circulating a dissolvent through a bypass passage extending at least partially through the frac plug in response to detecting the failure. In some embodiments, the method further includes providing a pressure relief pressure to a pressure relief valve in the bypass passage to permit the dissolvent be circulated past a distal end of the frac plug. The method may further include increasing a pressure in a hydraulic chamber of the setting tool to induce the seal element of the frac plug to engage the wellbore string. The method may further include at least one of the group consisting of opening a fluid path between the hydraulic chamber and a hydrostatic chamber at hydrostatic pressure and inducing a chemical reaction between chemical components to produce a gas into the hydraulic chamber to increase the pressure in the hydraulic chamber.

According to another aspect, the disclosure is directed to a frac package apparatus useful in hydraulic fracturing or stimulation operations. The apparatus includes: a perforating gun; a frac plug including a seal element movable from a first radially inward position to a second radially outward position; a dissolvable setting tool operably coupled to the perforating gun and the frac plug, the setting tool including an actuator operably coupled to the frac plug to selectively move the seal element from the first position to the second position in response to receiving a trigger signal, the dissolvable setting tool constructed of dissolvable materials such that the dissolvable setting tool degrades into individual particles less than one half inch diameter in wellbore fluids; and a controller carried by the dissolvable setting tool, the controller operable to provide the trigger signal to the actuator in response to detecting a predetermined depth in a wellbore.

In some embodiments the apparatus further includes a bypass passage extending through the frac plug and a pressure relief valve in the bypass passage.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

What is claimed is:

1. A wellbore system useful in hydraulic fracturing or stimulation operations, the system comprising:

a wellbore string extending into a subterranean wellbore;

a frac plug including a seal element movable from a first radially inward position to a second radially outward position to engage the wellbore string in response to movement to the second radially outward position;

a dissolvable setting device including an actuator operably coupled to the frac plug to selectively move the seal element from the first position to the second position in response to receiving a trigger signal, wherein the actuator of the setting tool includes a hydraulic chamber and a piston movable in response to a change in pressure in the hydraulic chamber to move the frac plug from the first radially inward position to the second radially outward position, and wherein the dissolvable setting device, including the piston and the hydraulic chamber, is constructed of dissolvable materials such that the dissolvable setting device degrades into individual particles less than one half inch diameter in wellbore fluids and or acid; and a controller carried by the dissolvable setting tool, the controller operable to detect a predetermined depth in the wellbore string, and to provide the trigger signal to the actuator in response to detecting the predetermined depth.

2. The wellbore system according to claim 1, wherein the wellbore system comprises a bypass passage extending at least partially through the frac plug, the bypass passage being open to receive a fluid from above the frac plug when the seal element is in the second position in the wellbore string.

3. The wellbore system according to claim 2, wherein the bypass passage is fluidly coupled with a pressure relief valve, the pressure relief valve operable to prevent flow through the bypass passage until activated and permit flow through the bypass passage once activated.

4. The wellbore system according to claim 3, wherein the pressure relief valve is one of a pop-off valve or rupture disc.

5. The wellbore system according to claim 1, further comprising a perforating gun section coupled permanently or temporarily to the setting tool and frac plug, wherein the perforating gun section, frac plug, and setting tool are each constructed at least partially of a dissolvable material.

6. The wellbore system according to claim 5, wherein the frac plug is operationally coupled to a upper end of the setting tool and the perforating gun operationally coupled to an upper end of the frac plug.

7. The wellbore system according to claim 1, wherein the hydraulic chamber of the setting tool is an air chamber at a surface atmospheric pressure, and wherein the actuator is selectively operable to open a fluid path between the air chamber and a hydrostatic chamber at hydrostatic pressure.

8. The wellbore system according to claim 7, further comprising a plug fluidly isolating the air chamber and the piston from the hydrostatic chamber, and wherein the actuator is operable to open a fluid opening through the plug.

9. The wellbore system according to claim 1, wherein the actuator of the setting tool incudes a chemical chamber that houses chemical components selectively reactive with one another to produce a gas into the hydraulic chamber.

10. The wellbore system according to claim 1, wherein the setting tool is a top-set setting tool operable to place a mandrel of the frac plug in tension to move the seal element to the second position and to move slips along a slip wedge, wherein the mandrel of the frac plug is constructed of a dissolvable metal, slip wedges are constructed of a degradable plastic, and wherein the seal element is constructed of a degradable elastomer.

11. The wellbore system according to claim 1, wherein the setting tool is a bottom-set setting tool operable to place a mandrel of the frac plug in compression.

12. The wellbore system of claim 1, wherein the wellbore string is one of a tubular, a casing, a drill string, and/or a liner.

13. A method for hydraulic fracturing or stimulation operations in a wellbore, the method comprising:

deploying a frac package into a wellbore string in the wellbore;

detecting a predetermined depth in the wellbore string with a controller of a setting tool carried by the frac package;

providing a trigger signal to an actuator of the setting tool in response to detecting the predetermined depth;

increasing a pressure in a hydraulic chamber of the setting tool in response to receiving the trigger signal, moving a piston of the setting tool in response to increasing the pressure;

moving a seal element of a frac plug carried by the frac package with the actuator in response to moving the piston, wherein moving the seal element engaging the seal element with the wellbore string to fluidly isolate a perforation zone in the wellbore;

pumping a fluid into the perforation zone isolated by the frac plug to hydraulically fracture or stimulate the wellbore; and degrading the setting tool, including the hydraulic chamber and the piston, into individual particles less than one half inch diameter in wellbore fluids in the wellbore.

14. The method of claim 13, further comprising triggering a perforating gun carried by the frac package to fire subsequent to engaging the seal element with the wellbore string.

15. The method of claim 14, further comprising detecting a failure of the perforating gun to fire in response to being triggered to fire, and circulating a dissolvent through a bypass passage extending at least partially through the frac plug in response to detecting the failure.

16. The method of claim 15, further comprising providing a pressure relief pressure to a pressure relief valve in the bypass passage to permit the dissolvent be circulated past a distal end of the frac plug.

17. The method of claim 13, further comprising at least one of the group consisting of opening a fluid path between the hydraulic chamber and a hydrostatic chamber at hydrostatic pressure and inducing a chemical reaction between chemical components to produce a gas into the hydraulic chamber to increase the pressure in the hydraulic chamber.

18. The method according to claim 13, wherein increasing the pressure in the hydraulic chamber includes creating a fluid opening through a plug that fluidly isolates the piston from a hydrostatic pressure.

19. A frac package apparatus useful in hydraulic fracturing or stimulation operations, the apparatus comprising:

a perforating gun;

a frac plug including a seal element movable from a first radially inward position to a second radially outward position;

a dissolvable setting tool operably coupled to the perforating gun and the frac plug, the setting tool including an actuator operably coupled to the frac plug to selectively move the seal element from the first position to the second position in response to receiving a trigger signal, wherein the actuator of the setting tool includes a hydraulic chamber and a piston movable in response to a change in pressure in the hydraulic chamber to move the frac plug from the first radially inward position to the second radially outward position, and wherein the dissolvable setting tool, including the piston and the hydraulic chamber, is constructed of dissolvable materials such that the dissolvable setting tool degrades into individual particles less than one half inch diameter in wellbore fluids; and a controller carried by the dissolvable setting tool, the controller operable to provide the trigger signal to the actuator in response to detecting a predetermined depth in a wellbore.

20. The apparatus of claim 19, further comprising a bypass passage extending through the frac plug and a pressure relief valve in the bypass passage.

* * * * *